US008475594B2

(12) United States Patent
Bright et al.

(10) Patent No.: US 8,475,594 B2
(45) Date of Patent: Jul. 2, 2013

(54) GALVANIZING BATH APPARATUS

(75) Inventors: Mark A. Bright, Sewickley, PA (US); Gregory C. Becherer, Hinckley, OH (US); Robert L. Grodeck, Cleveland, OH (US)

(73) Assignee: Pyrotek, Inc., Solon, OH (US)

( * ) Notice: Subject to any disclaimer, the term of this patent is extended or adjusted under 35 U.S.C. 154(b) by 546 days.

(21) Appl. No.: 12/595,757

(22) PCT Filed: Apr. 14, 2008

(86) PCT No.: PCT/US2008/060203

§ 371 (c)(1),
(2), (4) Date: Aug. 23, 2010

(87) PCT Pub. No.: WO2008/128162

PCT Pub. Date: Oct. 23, 2008

(65) Prior Publication Data

US 2010/0304034 A1 Dec. 2, 2010

Related U.S. Application Data

(60) Provisional application No. 60/911,347, filed on Apr. 12, 2007.

(51) Int. Cl.
*B05C 11/10* (2006.01)

(52) U.S. Cl.
USPC ..... 118/602; 118/442; 118/423; 118/429; 118/600; 118/603; 118/610; 118/612; 427/345; 427/337

(58) Field of Classification Search
USPC ..... 118/422, 423, 429, 602, 603, 610, 118/612
See application file for complete search history.

(56) References Cited

U.S. PATENT DOCUMENTS

| | | | | |
|---|---|---|---|---|
| 4,275,098 | A * | 6/1981 | Gunji et al. | 118/603 |
| 4,743,428 | A | 5/1988 | McRae et al. | |
| 5,310,412 | A | 5/1994 | Gilbert et al. | |
| 5,863,314 | A | 1/1999 | Morando | |
| 6,426,122 | B1 | 7/2002 | Ishii et al. | |

FOREIGN PATENT DOCUMENTS

| | | |
|---|---|---|
| JP | 207418 A | 8/1995 |
| WO | WO 97/48833 | 12/1997 |
| WO | WO 01/55468 A1 | 8/2001 |

OTHER PUBLICATIONS

McDermid et al., Galvanizing Bath Management During Galvanize to Galvanneal and Galvanneal to Galvanize Product Transitions, Galvatech '04 Conference Proceedings.
Sippola, New Technology: ZQ—Bath Cleaner in Production, GSI Technology, Inc.
Ajersch et al., Monintoring of Al and Fe Content Numerical Simulation of the Sorevco Galvanizing Bath During GA to GI Transition.
European Search Report from EP Application No. EP 08 74 5738.

* cited by examiner

*Primary Examiner* — Dah-Wei Yuan
*Assistant Examiner* — Stephen Kitt
(74) *Attorney, Agent, or Firm* — Fay Sharpe LLP

(57) ABSTRACT

A continuous galvanizing line uses a coating pot containing a molten zinc bath having bottom dross and further comprises a pump. The pump agitates the bottom dross so the bottom dross interacts with aluminum and converts to top dross, which can be removed without needing to stop the galvanizing line. A reaction vessel may also be used to provide a higher concentration of aluminum to react with the bottom dross.

7 Claims, 2 Drawing Sheets

GALVANIZING BATH APPARATUS

This application claims the benefit of U.S. Provisional Patent Application No. 60/911,347, filed Apr. 12, 2007.

BACKGROUND

The present disclosure relates to apparatuses and methods for reducing the buildup of bottom dross in a zinc bath and reducing the transition time between two bath states.

Galvanizing (GI) and galvannealing (GA) are two known processes. Galvanization is a chemical process that is used to coat steel or iron with zinc in order to reduce corrosion (specifically, rusting). In galvannealing, steel or iron that has been coated with zinc is then heated (annealed) to improve fabrication and corrosion resistance characteristics.

Continuous galvanizing or galvannealing is typically done by running a steel or iron sheet through a molten zinc bath contained in a coating pot. The zinc bath contains zinc (Zn), aluminum (Al), and iron (Fe) and usually has a temperature of 450-480° C. (840-890° F.). Zinc is the overwhelming component of the zinc bath. The aluminum content of the zinc bath ranges from 0.10 weight percent (wt %) to 0.4 weight percent. In GI, the aluminum content of the zinc bath is greater than 0.13 wt %. In GA, the aluminum content of the zinc bath is less than 0.13 wt %. In another related process called galvalume, the zinc bath contains 55 wt % Al and 45 wt % Zn. The iron content is usually very low (less than 0.1 wt %) and generally comes from the steel sheet itself.

The zinc-rich field of the Zn—Fe—Al phase diagram is helpful for understanding the chemical processes that occurs during GI and GA. In particular, the phase field changes around 0.13 wt % Al at these temperatures and different impurities (i.e. intermetallic compounds) occur in different phase fields. GA is usually operated within the δ+L phase field, wherein the impurity is $FeZn_7(\delta)$. This impurity is denser than the zinc bath itself and collects on the bottom of the coating pot; thus, it is also known as bottom dross. GI operates within the η+L phase field, wherein the impurity is $Fe_2Al_5(\eta)$. This impurity is less dense than the zinc bath itself and collects on the surface of the molten zinc bath in the coating pot; thus, it is also known as top dross. These impurities generally form because the solubility limit of Fe is reached in a local region. Dross particles can thus nucleate and grow.

The bottom dross and top dross are undesired. Whereas the top dross can be continuously removed by skimming the top of the zinc bath, the bottom dross cannot. Continued operation of the GA process thus builds up bottom dross, which can solidify. In addition, the bottom dross ($FeZn_7$) consumes the desired zinc reactant in the zinc bath. This aspect is also undesired.

Bottom dross can be removed. If the bottom dross has solidified, it can be mechanically removed by jack-hammering; however, this usually results in a week of downtime. Bottom dross can also be removed using scoops before it solidifies, but this method is dangerous, tedious and still results in downtime.

Bottom dross can be removed chemically by exploiting the differences between GA and GI. Aluminum is added to the zinc bath as solid ingots to change the phase field from δ+L to η+L. This allows the bottom dross ($FeZn_7$) to convert to top dross ($Fe_2Al_5$), which can then be skimmed off. However, this method of removing bottom dross has its own disadvantages. Typically, the transition time during which the bottom dross converts to top dross is 24-30 hours. During this transition time, the continuous galvanizing line produces only products having significantly lower value.

Galvannealed steel is widely used in the automobile, appliance, and construction industries because of its comparatively superior corrosion resistance properties. Thus, it would be desirable to continually run a galvannealing process or, at a minimum, reduce the transition time between the GA to GI processes.

BRIEF DESCRIPTION

The present disclosure is directed to apparatuses and methods for reducing the buildup of bottom dross in a zinc bath and reducing the transition time between two bath states. Generally, the apparatuses comprise a coating pot and a pump. The pump accelerates the conversion of bottom dross to top dross by intimately mixing the zinc-rich bottom dross with aluminum. This reduces the transition time between the two bath states (GA: low Al content to GI: higher Al content). If run continually, bottom dross buildup can also be reduced or prevented. Either result occurs in a more profitable continuous production line.

The pump has one of an inlet or an outlet located near the bottom of the coating pot (where bottom dross will build up). The other of the inlet and the outlet can be located in the molten zinc bath.

The apparatuses may further comprise a separate reaction vessel, located within or outside the coating pot. Aluminum may be added to the reaction vessel, increasing the Al content of the portion of the zinc bath inside the reaction vessel. The bottom dross is then mixed with this Al-enriched zinc bath via flow provided by the pump. Again, this accelerates the conversion of bottom dross to top dross.

The methods comprise mixing the bottom dross with an Al-enriched zinc bath. The method may further comprise providing a second Al-enriched zinc bath separate from the coating pot and contacting the second bath with the bottom dross, either in the coating pot or in the reaction vessel. The second zinc bath may or may not be derived from the zinc bath in the coating pot.

BRIEF DESCRIPTION OF THE DRAWINGS

The following is a brief description of the drawings, which are presented for the purposes of illustrating the exemplary embodiments disclosed herein and not for the purposes of limiting the same.

DETAILED DESCRIPTION

A more complete understanding of the components, processes and apparatuses disclosed herein can be obtained by reference to the accompanying drawings. These figures are merely schematic representations based on convenience and the ease of demonstrating the present disclosure, and are, therefore, size and dimensions of the devices or components thereof and/or to define or limit the scope of the present disclosure.

Figure 1:
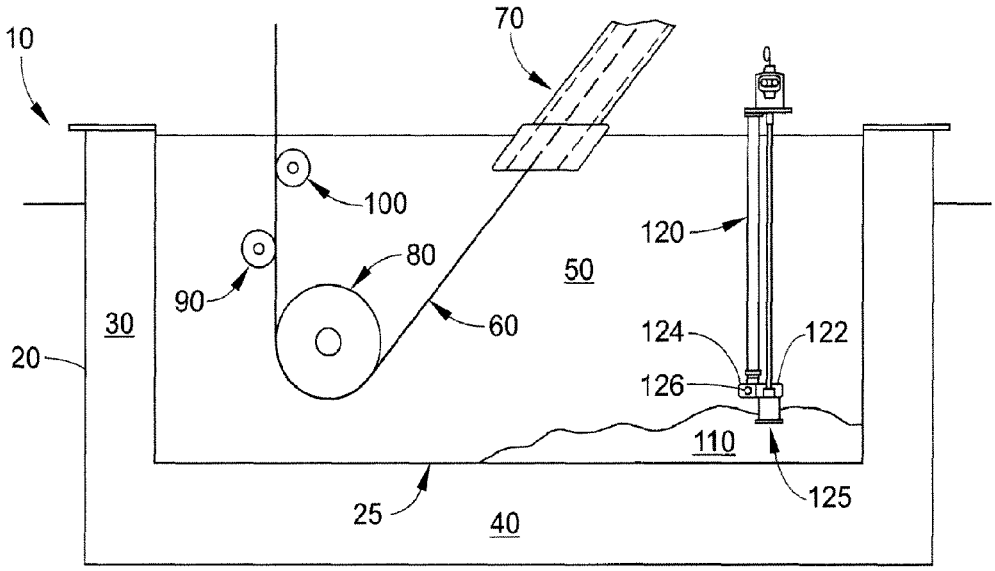
FIG. 1 is a schematic view of an exemplary embodiment of an apparatus of the present disclosure.

FIG. 1 is a cross-sectional view of an exemplary embodiment of an apparatus of the present disclosure. The apparatus 10 comprises a coating pot 20 defined by a sidewall 30 and a base 40. As shown here, the sidewall 30 and base 40 are an integral unit. The sidewall 30 and base 40 may contain passages used for various purposes, such as the entrance, exit, or circulation of the molten zinc bath. As shown here, the coating pot 20 has a flat base (flat base is shown, but pot may have a sloped base) and vertical sidewalls; however, the coating pot 20 may be of any shape. Contained within the coating pot 20 is a primary molten zinc bath 50. The molten zinc bath contains Zn, Fe, Al, and may contain other trace elements as well. A continuous galvanizing line (CGL) comprises a continuous steel sheet 60 that enters the primary zinc bath 50 from a snout 70 and is kept in tension by a sink roll 80 located within the coating pot 20. The steel sheet 60 then travels out of the primary zinc bath 50 and, typically, past a correcting roll 90 and a stabilizer roll 100 (sometimes a stabilizer roll is not used) which are on opposite sides of the steel sheet 60. If galvannealing is desired, the steel sheet 60 may then enter a galvannealing furnace (not shown) which further heats the steel sheet 60.

Located at the bottom 25 of the coating pot 20 is bottom dross 110. The bottom 25 of the coating pot 20 may be considered to be a lowest point in the coating pot 20, where dross particles will accumulate as they sink. Depending on the architecture of the base 40, there may be more than one such bottom 25. The bottom dross 110 may be in either a solid or viscous state and is approximately $FeZn_7$, particles. Located within the coating pot 20 is an impeller 122 of a circulation pump 120. An example of a circulation pump is an L-series Molten Metal Circulation Pump available from Metaullics Systems of Solon, Ohio. In this embodiment, the impeller 122 of the circulation pump 120 is located near a bottom 25 of the coating pot 20. As shown here, an inlet pipe 125, which is in communication with the impeller housing 124, is within the bottom dross 110. An impeller housing outlet 126, which is in fluid communication with the inlet pipe 125, is located in primary zinc bath 50, preferably in a zone having a relatively high Al concentration compared to the bottom dross 110.

The pump 120 operates by promoting the conversion of bottom dross to top dross. This conversion occurs during the transition from a GA process to a GI process. Aluminum is added to the primary molten zinc bath 50, which increases its Al concentration relative to that of the bottom dross 110. The recirculation pump 120 stirs up the bottom dross, either by sucking bottom dross 110 up through the inlet pipe 125 and expelling it into the primary zinc bath 50 at the outlet 126, or by impinging the primary zinc bath 50 collected from the outlet 126 into the bottom dross 110 through the inlet 125 in this example the inlet would be acting as an outlet and the outlet would be acting as an inlet). Either way, the flow created by the pump action promotes intimate interaction between the bottom dross 110 and the aluminum added to the primary zinc bath 50. This intimate interaction promotes the conversion of $FeZn_7$ to $Fe_2Al_5$ in a shorter transition time. The circulation pump may be run continuously to suspend the dross particles (and thus prevent their solidification) or intermittently to agitate the dross particles and force interaction during a GA to GI transition.

Figure 2:
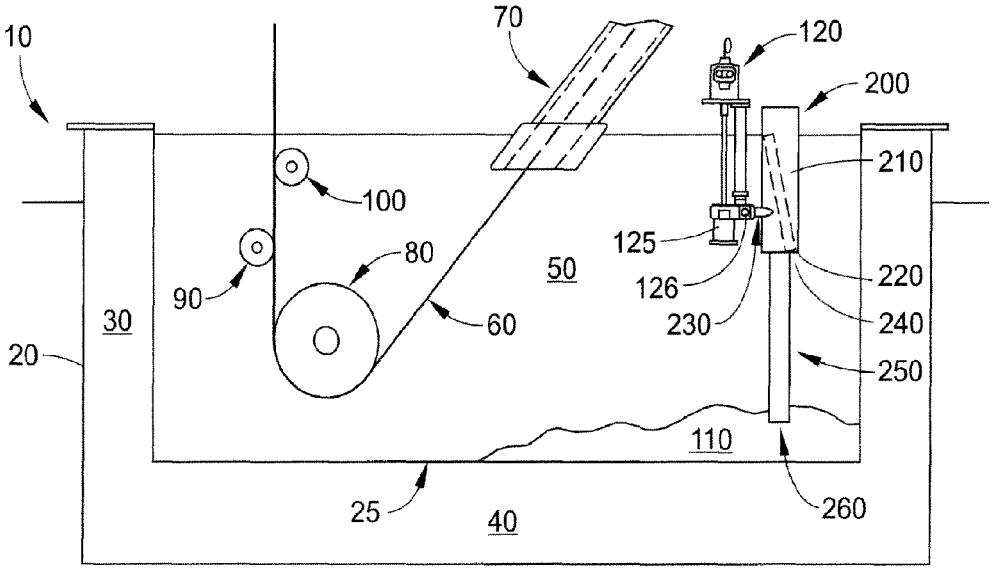
FIG. 2 is a schematic view of a second exemplary embodiment of an apparatus of the present disclosure.

FIG. 2 is a cross-sectional view of a second exemplary embodiment of an apparatus of the present disclosure. Here, the coating pot 20 comprises a reaction apparatus 200. In particular, the reaction apparatus 200 may be similar to the submergence apparatuses described in WO 2005/054521, including U.S. Pat. Nos. 6,217,823; 6,036,745; and 4,286,985 each of which are incorporated herein in their entirety. That apparatus is shaped so that incoming molten zinc creates a vortex wherein low-density aluminum is rapidly submerged and melted. Solid aluminum has a density of about 2.7 grams per cubic centimeter (g/cc) and liquid zinc has a density of about 6.6 g/cc. Accordingly, the reaction apparatus 200 is properly designed to promote the submergence of the solid aluminum into the liquid zinc, which is described in more detail in WO 2005/054521.

The reaction apparatus 200 is also defined by a sidewall 210 and base 220. The reaction apparatus 200 further comprises an entry port 230 and an exit port 240. As shown here, the entry port 230 is in the sidewall 210 and the exit port 240 is in the base 220. A pipe 250 is connected to the exit port 240 and the output end 260 of the pipe 250 is located near a bottom 25 of the coating pot 20. Of course, the reaction apparatus 200 and pipe 250 may be an integral unit (i.e. unitary). In this embodiment, the impeller housing outlet 126 of the pump 120 is connected to and in communication with the entry port 230 of the reaction apparatus 200 such that the interior of the reaction apparatus 200 can be filled from the primary molten zinc bath 50 in the coating pot 20. Molten zinc is drawn into the inlet pipe 125 through the impeller housing 124 and into the reaction apparatus 200 through the pipe 230. Of course, the impeller housing 124 and pipe 230 may be an integral unit as well. When used, aluminum, either in the form of Al ingots, Zn—Al ingots or granular pellets, is added to the reaction apparatus 200 which results in the aluminum melting in the zinc bath. This increases the Al concentration in the molten zinc inside the reaction apparatus 200. That molten zinc and Al combination is then discharged through the output end 260 onto or into the bottom dross 110. Again, this forces intermingling of the bottom dross 110 with the added aluminum.

Figure 3:
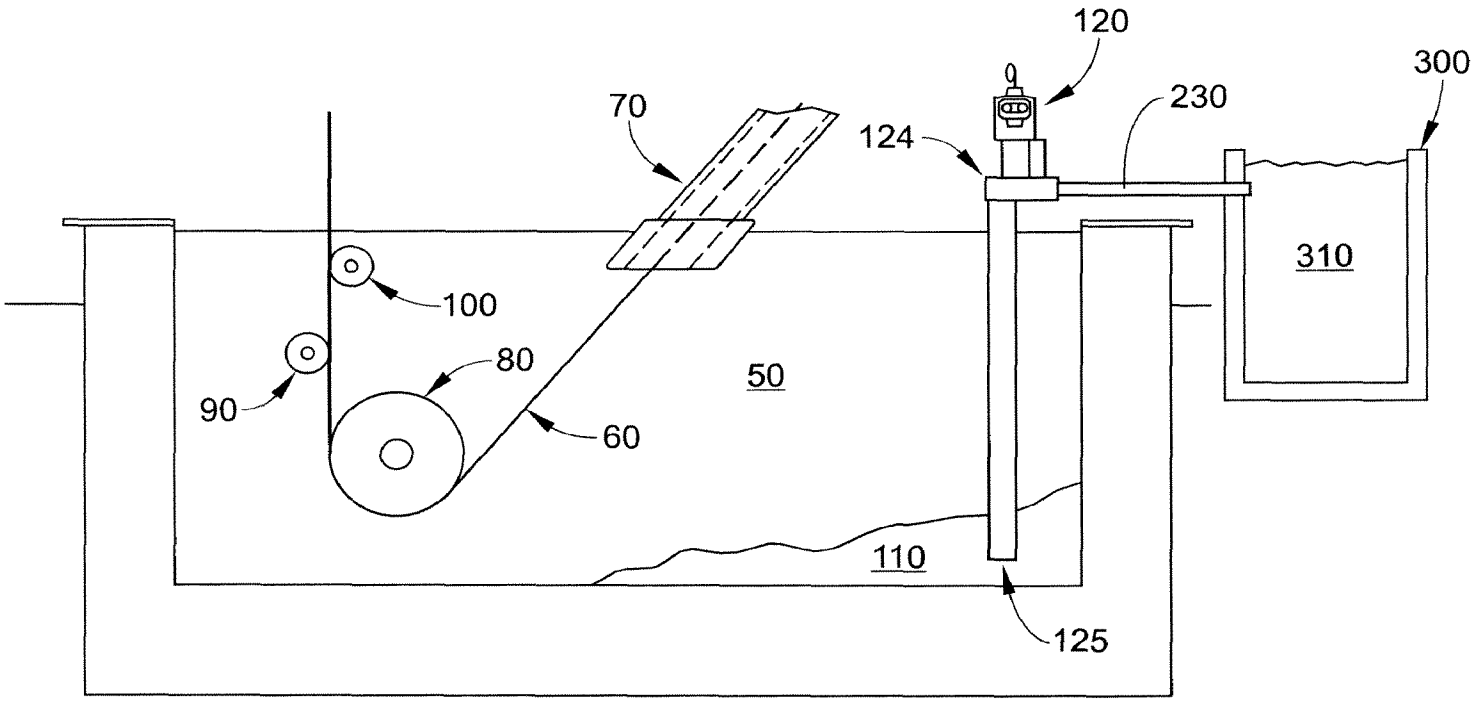
FIG. 3 is a schematic view of a third exemplary embodiment of an apparatus of the present disclosure.

FIG. 3 is a cross-sectional view of a third exemplary embodiment of an apparatus of the present disclosure. This embodiment differs from that of FIG. 2 by including a reaction vessel 300 which contains a second molten zinc bath 310. The primary molten zinc bath 50 of the coating pot 20 can be separated from the second molten zinc bath 310 of the reaction vessel 300. The pump 120 collects bottom dross 110 through the inlet pipe 125 and transfers the bottom dross 110 through the impeller housing 124 to the second molten zinc bath 310. The second molten zinc bath 310 has a higher Al content than the primary molten zinc bath 50 of the coating pot 20. This higher Al content can be achieved by operating the reaction vessel 300 as a GI process or adding aluminum to the second molten zinc bath 310. Regardless, the bottom dross 110 converts to top dross in the reaction vessel 300, where it can be skimmed off. In this embodiment, there is no need to change the Al content of the primary molten zinc bath 50. Thus, the coating pot 20 can continuously run as a GA process without needing to transition to GI at all.

As shown here, the reaction vessel 300 is outside the coating pot 20. Of course, their relative location is not important. For example, the reaction vessel 300 could be located inside the coating pot 20. The key is that the interior of the reaction vessel 300 (i.e. the second molten zinc bath 310) can be separated from the primary zinc bath 50 so that the local Al concentration in the reaction vessel 300 can be increased relative to that of the primary zinc bath 50. If desired, the reaction vessel 300 may be configured so that the second molten zinc bath 310 can be replenished from the primary molten zinc bath 50. For example, as mentioned above, the iron content in the primary zinc bath 50 is very low and generally comes from the steel sheet 60 itself.

Generally, all three embodiments move the bottom dross so that it can interact with aluminum and form top dross. In FIGS. 2 and 3, a molten zinc bath having a relatively high concentration of Al is formed and the bottom dross is interacted with that higher-concentration zinc bath. As a result, the transition time from GA to GI processes is reduced. In the embodiment of FIG. 3, the coating pot may not need to be transitioned to GI at all.

The present disclosure has been described with reference to certain exemplary embodiments. Obviously, modifications and alterations will occur to others upon reading and understanding the preceding detailed description. It is intended that the present disclosure be construed as including all such modifications and alterations insofar as they come within the scope of the appended claims or the equivalents thereof.

The invention claimed is:

1. A galvanizing bath apparatus for reducing the buildup of bottom dross, comprising:

a coating pot defined by a sidewall and a base, and having a bottom;

a pump, the pump having an intake and an outflow; and a reaction apparatus having a sidewall and a bottom wall, an entry port in said sidewall and an exit port in said bottom wall;

wherein the outflow of the pump is in communication with the entry port of the reaction apparatus;

wherein said exit port faces said coating pot bottom such that material exiting the reaction apparatus is directed towards the bottom of the coating pot;

wherein the reaction apparatus is configured to allow matter in the interior of the reaction apparatus to move into the coating pot and introduce the matter into the coating pot near the bottom; and wherein the reaction apparatus further comprises a pipe in fluid communication with said exit port which opens near the bottom of the coating pot.

2. A galvanizing bath apparatus for reducing the buildup of bottom dross, comprising:

a coating pot containing a primary zinc bath defined by a sidewall and a base, and having a bottom;

a pump, the pump having an inlet adjacent the coating pot bottom and an outlet remote from the coating pot; and a reaction vessel separated from the coating pot and containing a second zinc bath;

wherein the primary zinc bath and the second zinc bath are not in fluid communication other than the pump configured to move material from the bottom of the coating pot into the reaction vessel.

3. The apparatus of claim 1 wherein the reaction apparatus comprises a bowl having a substantially cylindrical sidewall.

4. The apparatus of claim 1 wherein said pump intake is located remote from the coating pot bottom.

5. The apparatus of claim 1 wherein said pump comprises an impeller disposed within a pump housing.

6. The apparatus of claim 2 wherein said pump comprises an impeller dispersed within a pump housing.

7. The apparatus of claim 2 wherein the second zinc bath has a higher aluminum concentration than the primary zinc bath.

* * * * *